US007458642B1

(12) United States Patent
Spicer

(10) Patent No.: US 7,458,642 B1
(45) Date of Patent: Dec. 2, 2008

(54) SLING CHAIR CONSTRUCTION HAVING NON-WEIGHT BEARING MATERIAL AND METHOD OF CONSTRUCTING SAME

(75) Inventor: Aaron Daniel Spicer, Wadena, MN (US)

(73) Assignee: Homecrest Outdoor Living, LLC, Wadena, MN (US)

( * ) Notice: Subject to any disclaimer, the term of this patent is extended or adjusted under 35 U.S.C. 154(b) by 0 days.

(21) Appl. No.: 11/821,682

(22) Filed: Jun. 25, 2007

(51) Int. Cl.
*A47C 7/02* (2006.01)
*B68G 7/00* (2006.01)

(52) U.S. Cl. ..... 297/452.13; 29/91.1

(58) Field of Classification Search ..... 297/452.56, 297/452.13, 440.11, 218.1, 219.1, 225, 228.1, 297/229; 29/91.1
See application file for complete search history.

(56) References Cited

U.S. PATENT DOCUMENTS 4,592,126 A 6/1986 Bottemiller ..... 29/446
5,318,348 A * 6/1994 Hess ..... 297/440.11
5,393,126 A * 2/1995 Boulva ..... 297/452.56
5,762,403 A * 6/1998 Robinson ..... 297/440.11
6,152,534 A * 11/2000 Maeda et al. ..... 297/452.56
6,341,822 B2 1/2002 Apissomian ..... 297/440.11
6,345,428 B2 2/2002 Apissomian ..... 29/428

* cited by examiner

*Primary Examiner*—Milton Nelson, Jr.
(74) *Attorney, Agent, or Firm*—Westman, Champlin & Kelly, P.A.; Z. Peter Sawicki

(57) ABSTRACT

A chair construction includes a chair frame with a seat portion and a back portion and a flexible envelope that encompasses the chair frame. The envelope includes first and second layers having a first selected width between first left and right edges. The first and second layers are constructed of a slingable material. A third layer constructed of a non-slingable material and has a second selected width between second left and right edges where the second selected width is shorter than the first selected width of the first and second layers. The first and second left and right edges are aligned and the layers are secured together proximate the left and right edges to form the flexible envelope. When the envelope is positioned over the frame, the third layer is stretched a greater distance than the first and second layers, such that the non-slingable layer remains taut.

19 Claims, 4 Drawing Sheets

SLING CHAIR CONSTRUCTION HAVING NON-WEIGHT BEARING MATERIAL AND METHOD OF CONSTRUCTING SAME

FIELD OF THE INVENTION

The present invention relates to a chair construction. In particular, the present invention relates to a chair with an envelope having a layer of non-slingable material and a method of constructing the chair.

BACKGROUND OF THE INVENTION

One type of outdoor furniture that has become popular is a sling style chair. Typically, a sling style chair includes a sheet or sheets held in tension between two longitudinal bars. The bars are typically held apart by a number of external braces.

Because the sheet or sheets are held in tension and also must bear the weight of the person sitting on the chair, only certain types of material can be used as the sheet or sheets on a sling style chair. These materials are known as "slingable" materials. Slingable materials are load-bearing materials that have sufficient strength to withstand the forces exerted by a person sitting on the chair as well as sufficient resiliency to withstand the tension placed on the material due to the chair's construction. Further, a slingable material is able to withstand the force of a person repeatedly sitting on the chair over a long period of time without sagging or drooping.

Due to the strength and resiliency of slingable materials, slingable materials typically do not readily accept patterns and dyes. Certain materials, such as acrylic, which readily accept patterns and/or dyes of vibrant colors, are non-slingable materials which are not typically utilized in the construction of a sling style chair. Because of the patterns and/or color, many consumers would prefer to have a sling style chair utilizing non-slingable materials. In tension, non-slingable materials do not withstand the forces on the material and are susceptible to tearing, stretching. Over time a non-slingable material will begin to sag which is detrimental to the appearance and comfortability of the chair.

SUMMARY OF THE INVENTION

The present invention includes a chair construction having a chair frame comprising a seat portion and a back portion. A flexible envelope encompasses the chair frame where the envelope includes first and second layers both of which have a first selected width between first left and right edges. The first and second layers are constructed of a slingable material. A third layer is constructed of a non-slingable material where the third layer has a second selected width between second left and right edges where the second selected width is shorter than the first selected width of the first and second layers. The first and second left edges and the first and second right edges are aligned and the layers are secured together proximate the left and right edges to form the flexible envelope. The chair frame is positioned between the first and second layers and into a selected position. With the envelope positioned over the frame, each of the three layers is stretched taut to a width of the chair. The third layer of non-slingable material is stretched a greater distance than the first and second layers, such that the non-slingable layer is able to withstand the forces placed upon the material including the tension on the material due to the chair's construction and a load that is applied to the non-slingable material when a person is seated or object is placed on the envelope.

The present invention also includes a flexible envelope for positioning on a chair frame, the envelope comprises a first layer comprising a slingable material having a first selected width, a second layer comprising a slingable material having a width substantially the same as the first selected width of the first layer and a third layer comprising a non-slingable material having a second selected width that is shorter than the first selected width of the first and second slingable materials. Side edges of the first, second and third layers are substantially aligned and folded over to form a six-layer composite where the layers of non-slingable material are adjacent. A hem is produced by sewing through the six-layer composite along the side edges to form the envelope.

The present invention also includes a method of constructing a sling style chair that includes providing a frame having a back portion and a seat portion. The method includes providing first and second layers of slingable material positioned adjacent each other and having a first selected width and providing a non-slingable material having a second selected width that is shorter than the first selected width of the slingable material. The side edges of the three layers are aligned and the material is folded over to form a six-layer composite along the side edges where the layers of non-slingable material are adjacent. A hem is produced by sewing through the six layer composite proximate the side edges. The envelope is then positioned over the back portion and seat portion and the envelope is sufficiently stretched such that the non-slingable material remains taut throughout use and is able to withstand the forces applied thereto when an object or person is seated in the chair.

DETAILED DESCRIPTION OF ILLUSTRATIVE EMBODIMENTS

Figure 1:
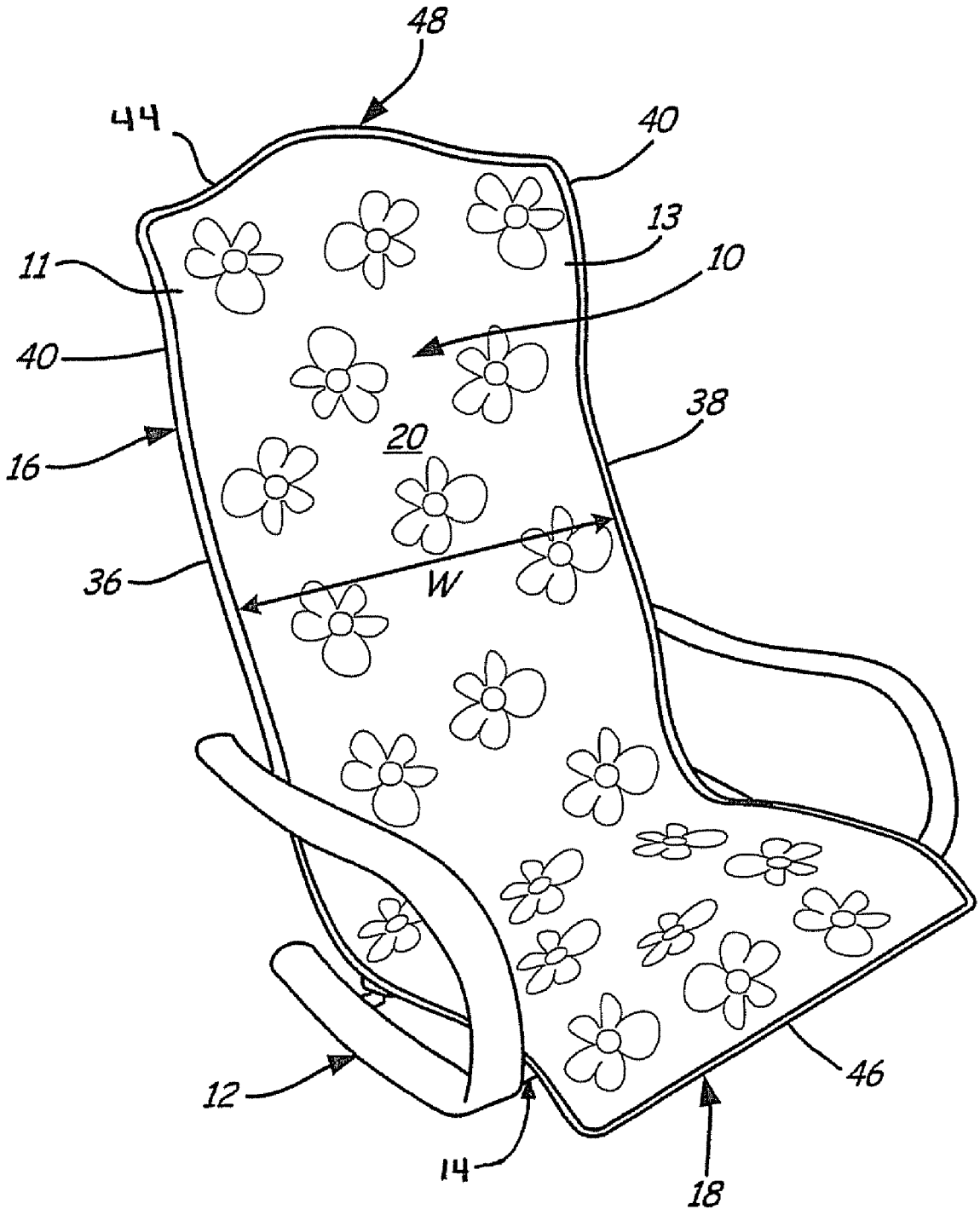
FIG. 1 is a perspective view of a sling style chair of the present invention having an envelope attached thereto.
Figure 2:
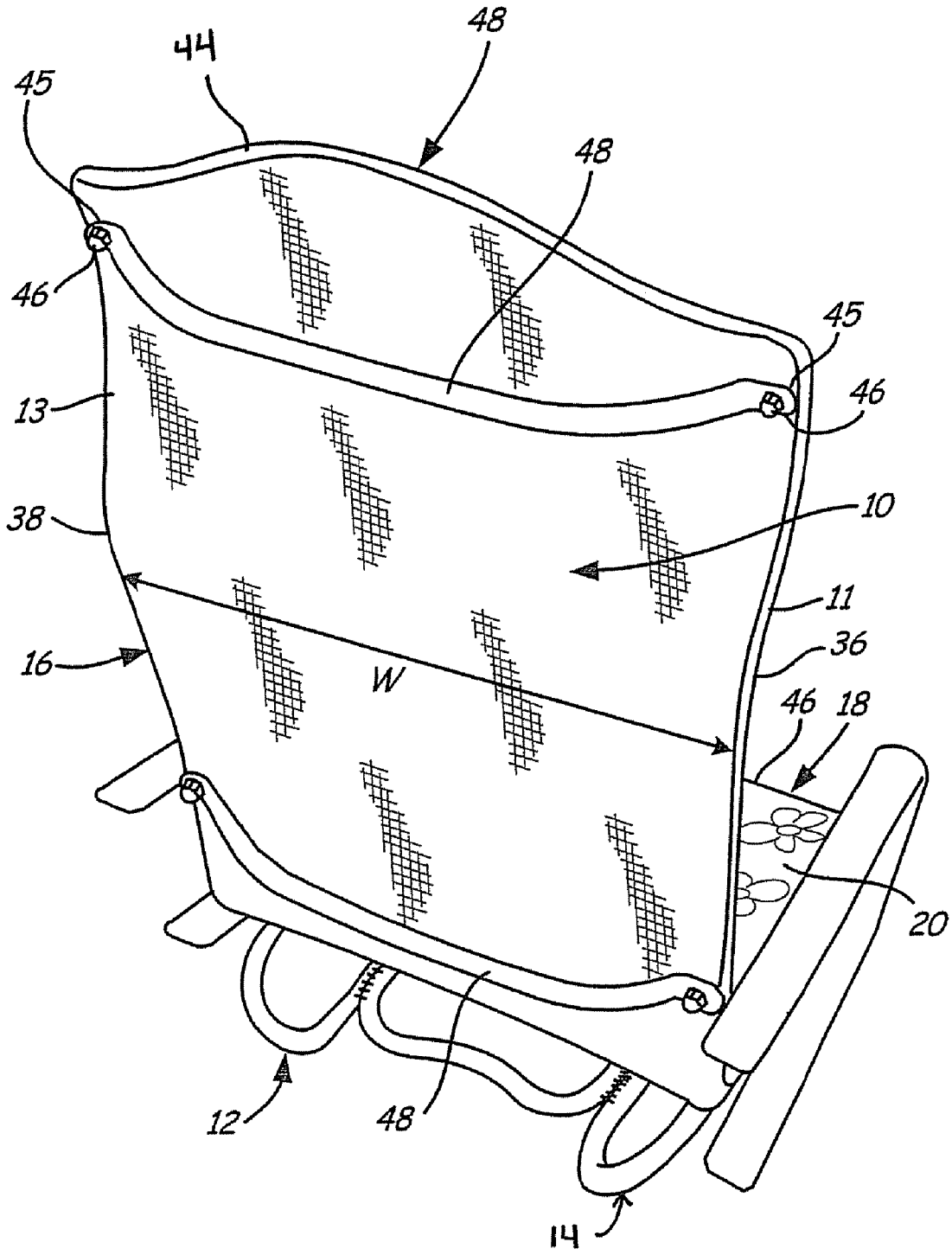
FIG. 2 is another perspective view of a sling style chair of the present invention having an envelope attached thereto.

The present invention includes an envelope for positioning on a sling style chair 12 as illustrated in FIGS. 1 and 2 at 10. The envelope 10 encompasses a back portion 16 and a seat portion 18 of a chair frame 14 where the envelope 10 includes a top layer 20 constructed of a non-slingable material. The envelope 10 also includes a middle layer 22 (as illustrated in FIGS. 3-6) and a bottom layer 24 constructed of a slingable material where in the layers 22 and 24 provide support to the top layer 20. Each of the three layers 20, 22 and 24 is stretched taut to a width W of the sling style chair 12.

What is meant by a slingable material is a material that is able to withstand a constant tension placed upon the material due to the construction of the sling style chair. Also, a slingable material is able to withstand a load or force placed upon the material created by a person sitting on the chair or an object being placed on the chair. A slingable material must also be sufficiently resilient to maintain a taut configuration when a force is repeatedly placed upon and removed from the envelope such that the material does not tear, droop or sag. Typical slingable materials include, but are not limited to, woven vinyl, vinyl jacquard blend, polypropylene, VPC (vinyl coated polyester), faux leather and materials constructed of polypropylene olefin fibers such as those sold under the Hercalon® trademark owned by Hercules Incorporated of Wilmington, Del., and combinations thereof.

A non-slingable material is a material that typically is not able to withstand the tension created by the construction of a sling style chair. Additionally, a non-slingable material is not able to withstand the forces or loads placed upon the material when a person is seated on a sling style chair. Over time, a non-slingable material will begin to sag, droop or tear because the non-slingable material does not have sufficient strength and resiliency required for use in a sling style chair. Typical non-slingable materials include, but are not limited to, acrylic, open weave vinyl, vinyl prints, olefin, polyester, acrylic blends and combinations thereof.

Non-slingable materials may be desired for use in a sling style chair because non-slingable materials are capable of accepting dyes having vibrant colors and/or unique patterns. However, sling style chairs are not typically available utilizing non-slingable materials because the non-slingable material stretches, sags and/or tears over time. The construction of the envelope 10 allows the sling style chair 12 to utilize a non-slingable material and thereby have designs and colors that are typically desired by consumers.

Figure 3:
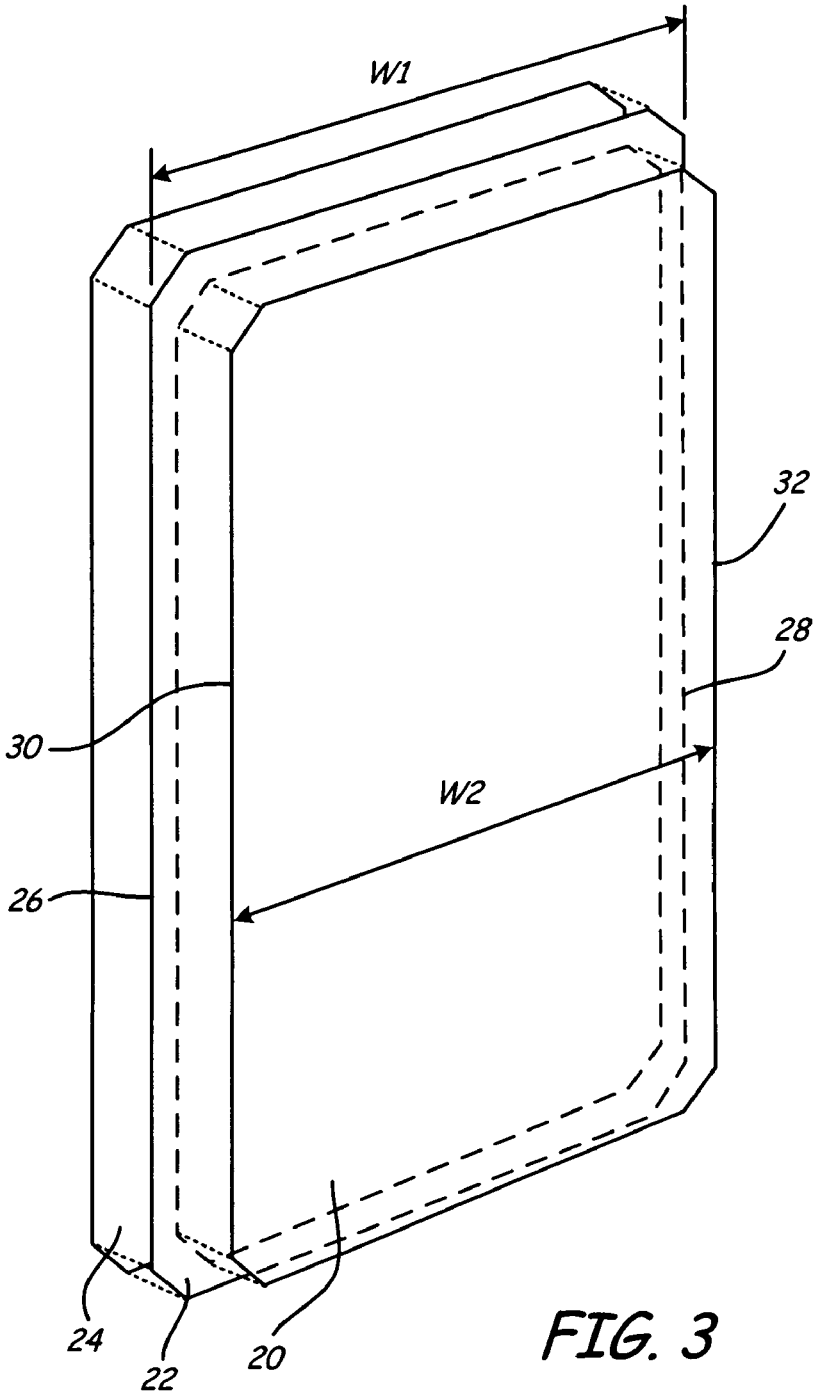
FIG. 3 is a top view of the layers of material of the envelope of the present invention.
Figure 4:
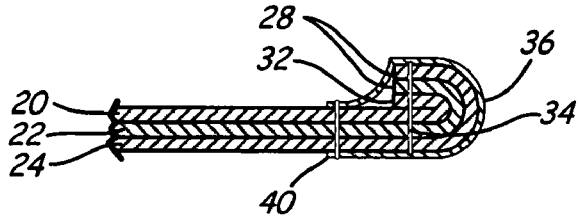
FIG. 4 is a sectional view of a left side edge of the envelope of the present invention.

Referring to FIGS. 3 and 4, the envelope 10 is constructed by aligning left and right side edges 26, 28 of the bottom and middle layers 24, 22 which have a first selected width W1. The top layer 20, having a second selected width W2, which is shorter than the width W1, is positioned on the middle layer 22. Left, right and side edges 30, 32 of the top layer 20 are aligned with the left and right side edges 26, 28 of the bottom and middle layers 24, 22, respectively.

The aligned left side edges 26 and 30 are folded over upon itself to form a six-layer composite. The aligned right side edges 28 and 32 are also folded over upon itself to form a six-layer composite.

Figure 5:
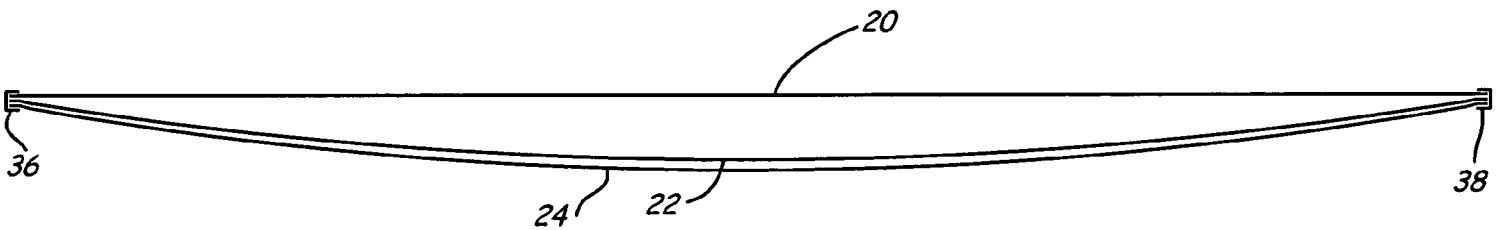
FIG. 5 is a sectional view of the envelope of the present invention in a slack configuration.

In both the left and right six-layer composites, the first and sixth layers are formed from the bottom layer 24 of slingable material, and the second and fifth layers are formed from the middle layer 22 of slingable material. The third and fourth middle layers are formed from the top layer 20 of non-slingable material. A hem 34 is produced by sewing through all six layers to form side edges 36, 38 of the envelope 10 such that the top layer 20 is taut and the middle layer 22 and the bottom layer 24 are slack as illustrated in FIG. 5.

The bottom and middle layers 24, 22 which form the first, second, fifth, and sixth layers of the six-layer composite provide support to the top layer 20 which is a non-slingable material and which forms the interior third and fourth layer of the six layer composite. The outer layers 22, 24 of the slingable material prevent the top layer 20 of the non-slingable material from tearing along the side surface when the frame 12 is positioned within the envelope 10 and the material layers 20, 22 and 24 are stretched taut.

Figure 6:
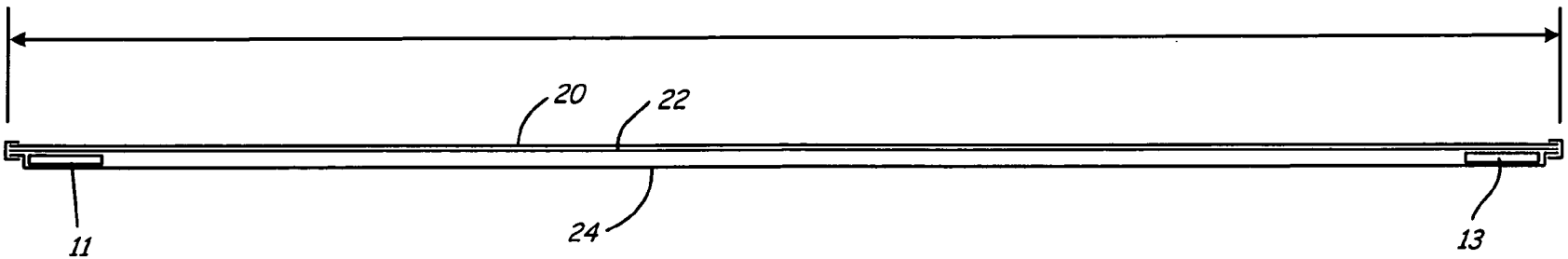
FIG. 6 is a sectional view of the envelope of the present invention encompassing the frame in a taut configuration.

Referring to FIGS. 1, 2 and 6, the frame 12 includes left and right side rails 11, 13 that engage the side edges 36, 38 of the envelope 10. The contact of the side rails 11, 13 and the side edges 36, 38 place a concentrated force on the side edges 36, 38 along the length of the side rails 11, 13 when the three layers 20, 22 and 24 are in tension. The concentrated force increases when a load is positioned onto the envelope 10. The construction of the left and right side edges 36, 38 of the envelope 10 prevent the non-slingable material from tearing at the side edges 36, 38 by utilizing the slingable bottom and middle layers 24, 22 as support for the non-slingable top layer 20.

A welt 40 of a non-slingable or a slingable material can be sewn over the hem of the left and ride side edges 36, 38 to cover the six-layer composite to provide a more pleasing appearance as best illustrated in FIG. 4. The welt 40 is not necessary to maintain the integrity of the envelope 10.

By way of example, when the three layer composite is folded in the other direction where the non-slingable top layer 20 forms the outer layers of the six-layer composite, the top layer 20 of non-slingable material provides support to the slingable bottom and middle layers 24, 22. The top layer 20 of non-slingable material is not able to withstand the forces created by the tension on the material by the construction of the sling style chair 12 and a load positioned on the envelope 10, such as when a person sits on the envelope 10, resulting in the non-slingable material tearing at the side edges 36, 38.

Referring back to FIGS. 1, 2 and 6, the frame 12, having the spaced apart left and right rails 11, 13, is positioned within the envelope 10 from a bottom edge 46 and between the bottom and middle layers 24, 22 which are constructed from a slingable material. The rails 11, 13 are positioned within the envelope 10 to position the frame 12 in a selected position with respect to a top edge 44 and the bottom edge 46 of the envelope 10 such that slits 45 in the bottom layer 24 align with peg 46 extending from the rails 11, 13. Support bars 48 engage the pegs 46 in the rails 11, 13 to retain the rails 11, 13 spaced apart the selected distance W, which is the width of the chair. With the support bars 48 retaining the rails 11 and 13 apart the distance W, the three layers 20, 22, 24 of the envelope 10 are in tension.

As each of the three layers 20, 22, 24 is stretched to the width W, the top layer 20 of non-slingable material is stretched a greater distance than the middle and bottom layers 22, 24 of slingable material such that the non-slingable material is in greater tension than the slingable material. The tension is created by stretching the non-slingable material from the width W2 to the width W, an increase of between about 1% and 4% of the width W2 prevents the top layer 20 from sagging or drooping during use over time. Typically the percent stretch is about 1.25%.

Because the middle layer 22 and the top layer 20 are in tension, the layers 20, 22 are adjacent each other such that when a person sits on the envelope 10, the middle layer 22 provides support to the top layer 20 and aids in preventing the top layer 20 from sagging, drooping or tearing during use. The slingable layers are typically stretched to increase the width to between about 1 and 5.5 percent of the width W1. Typically the percent stretch is about 2.5%.

Also, because most of the stress from the rails 11 and 13 is placed at the left and right edges 36, 38 of the envelope 10, the construction as illustrated in FIG. 3 where the top layer 20 of non-slingable material is supported by the middle and bottom layers 22, 24 of slingable material, the top layer 20 of non-slingable material is not as susceptible to tearing or stretching because the middle and bottom layers 22, 24 of slingable material provide support to the non-slingable material thereby increasing the usefulness and life of the envelope 10 of the chair 12.

Although the present invention has been described with reference to preferred embodiments, workers skilled in the art will recognize that changes may be made in form and detail without departing from the spirit and scope of the invention.

What is claimed is:

1. A chair construction comprising:

a chair frame comprising a seat portion and a back portion; and a flexible envelope encompassing the chair frame, the envelope comprising first and second layers comprising a slingable material wherein the first and second layers form the envelope that encompasses the chair frame and a third layer comprising a non-slingable layer attached to the slingable layers along a portion of the envelopes' perimeter wherein the three layers are bent back to form a six layer composite wherein the non-slingable layers are adjacent each other and a hem is formed by sewing through the six layer composite.

2. The chair construction of claim 1 wherein the third layer is attached to the first and second layers along opposite side edges.

3. The chair construction of claim 1 wherein the first and second layers have a first selected width between a first right edge and a first left edge and the third layer has a second selected width between a second right edge and a second left edge, the second selected width being shorter than the first selected width, wherein said first and second right edges and first and second left edges are aligned prior to bending the three layers back to form the six layer composite.

4. The chair construction of claim 1 and further comprising a welt covering the six layer composite.

5. The chair construction of claim 1 wherein the non-slingable material comprises acrylic.

6. The chair construction of claim 1 wherein the non-slingable material is selected from the group consisting essentially of open weave vinyl, vinyl prints, olefin, polyester, acrylic blends and combinations thereof.

7. The chair construction of claim 1 wherein the frame comprises left and right side rails spaced apart by at least one support bar.

8. The chair construction of claim 1 wherein the slingable material is selected from the group consisting essentially of woven vinyl, vinyl jacquard blend, polypropylene, faux leather and materials constructed of polypropylene olefin fibers and combinations thereof.

9. A chair construction comprising:

a chair frame comprising a seat portion and a back portion; and a flexible material envelope encompassing the chair frame, the envelope comprising first and second layers, each having right and left edges, comprising a slingable material and having a first selected width, wherein the first and second layers form the envelope that encompasses the chair frame and a third layer, having right and left edges, comprising a non-slingable layer having a second width shorter than the first width and wherein portions of the right and left edges of the third layer are attached to portions of the right and left edges of the first and second layers along a length thereof and wherein when the envelope encompasses the chair frame the third layer is placed in greater tension than the first and second layers.

10. The chair construction of claim 9 wherein the third layer is attached to the first and second layers along opposite right and left edges.

11. The chair construction of claim 9 wherein the three layers are bent back to form a six layer composite wherein the non-slingable layers are adjacent each other and a hem is sewn through the six layer composite.

12. The chair construction of claim 11 and further comprising a welt covering the six layer composite.

13. The chair construction of claim 9 wherein the non-slingable material comprises acrylic.

14. The chair construction of claim 9 wherein the non-slingable material is selected from the group consisting of open weave vinyl, vinyl prints, olefin, polyester, acrylic blends and combinations thereof.

15. The chair construction of claim 9 wherein the frame comprises left and right side rails spaced apart by at least one support bar.

16. The chair construction of claim 9 wherein the slingable material is selected from the group consisting of woven vinyl, vinyl jacquard blend, polypropylene, faux leather and materials constructed of polypropylene olefin fibers and combinations thereof.

17. A method of constructing a chair comprising:

providing first and second layers of a slingable material having a first width between side edges thereof;

providing a third layer of a non-slingable material having a second width between side edges thereof, the second width being shorter than the first width;

aligning the side edges of the first, second and third layers;

sewing a hem proximate the side edges of the first, second and third layers to attach the layers together;

providing a chair frame comprising a back portion and a seat portion; and positioning the chair frame between the first and second layers to place the first, second and third layers into tension wherein the tension on the third layer is greater than the tension on the first and second layers such that the third layer does not sag or droop over time with use.

18. The method of claim 17 and further comprising bending the three layers back at the side edges to form a six layer composite wherein the non-slingable material layers are adjacent prior to sewing the hem.

19. The method of claim 17 wherein positioning the frame between the first and second layers to place the first, second and third layers into tension comprises positioning first and second side rails proximate the left and right side edges of the first and second layers and securing the side rails a selected distance apart by attaching at least one support bar to the left side rail and the right side rail.

* * * * *